US010870048B1

(12) United States Patent
Rose

(10) Patent No.: US 10,870,048 B1
(45) Date of Patent: Dec. 22, 2020

(54) SQUIRREL GATHERING NUTS GAME APPARATUS AND METHOD

(71) Applicant: Anthony Rose, Rogers, AR (US)

(72) Inventor: Anthony Rose, Rogers, AR (US)

( * ) Notice: Subject to any disclaimer, the term of this patent is extended or adjusted under 35 U.S.C. 154(b) by 0 days.

(21) Appl. No.: 16/657,388

(22) Filed: Oct. 18, 2019

Related U.S. Application Data

(63) Continuation-in-part of application No. 15/806,628, filed on Nov. 8, 2017, now abandoned.

(51) Int. Cl.
*A63F 3/00* (2006.01)
*A63F 1/04* (2006.01)
*A63F 9/04* (2006.01)

(52) U.S. Cl.
CPC ..... *A63F 3/00006* (2013.01); *A63F 1/04* (2013.01); *A63F 3/00697* (2013.01); *A63F 3/0052* (2013.01); *A63F 3/00895* (2013.01); *A63F 9/04* (2013.01); *A63F 2001/0441* (2013.01); *A63F 2003/00876* (2013.01); *A63F 2003/00943* (2013.01)

(58) Field of Classification Search
CPC ..... A63F 3/00006; A63F 3/00097; A63F 3/0052; A63F 3/000088; A63F 3/00145; A63F 2003/00747; A63F 1/04
See application file for complete search history.

(56) References Cited

U.S. PATENT DOCUMENTS 1,439,616 A 12/1922 Diehl
1,656,943 A 1/1928 Firestone
2,585,268 A * 2/1952 Olsen ..... A63F 3/00697 273/258
3,309,092 A 3/1967 Hardesty et al. ..... 273/134
3,564,732 A * 2/1971 Lynd ..... G09B 17/00 434/167
3,860,242 A 1/1975 Martin ..... 273/134
4,003,578 A 1/1977 Jones ..... 273/134
4,004,810 A 1/1977 Henrie ..... 273/134
4,016,939 A 4/1977 Thron ..... 273/134
4,128,246 A 12/1978 Hicks et al. ..... 273/243
4,290,608 A 9/1981 Brown ..... 273/256
4,317,570 A * 3/1982 Brunton ..... A63F 3/00085 273/246
4,346,889 A * 8/1982 Barlow ..... A63F 3/00097 273/153 S
4,375,288 A 3/1983 Guertin ..... 273/273
4,377,287 A 3/1983 Erwin ..... 273/252
4,411,432 A 10/1983 Stevens ..... 273/251
4,426,084 A 1/1984 Michel ..... 273/254
4,448,421 A 5/1984 Zaruba et al. ..... 273/243
4,453,718 A 6/1984 Christoperson ..... 273/249
4,484,749 A * 11/1984 Charney ..... A63F 3/00072 273/254
4,501,425 A 2/1985 Alvarado ..... 273/256
(Continued)

*Primary Examiner* — Joseph B Baldori

(74) *Attorney, Agent, or Firm* — Keisling & Pieper PLC; David B. Pieper; Trent C. Keisling

(57) ABSTRACT

A multiple-board squirrel-gathering-nuts game including a tree board with a starting position, movement markers, a card access position, nut positions, multiple nut values, multiple launch positions, multiple launch directions, and landing positions along with dice, squirrel position markers, and nut position markers providing an unlimited scalable squirrel game.

18 Claims, 8 Drawing Sheets

(56) References Cited

U.S. PATENT DOCUMENTS

| | | | | |
|---|---|---|---|---|
| 4,526,376 | A * | 7/1985 | Rosenwinkel | A63F 9/20 273/249 |
| 4,569,527 | A | 2/1986 | Rosenwinkel et al. | 273/251 |
| 4,614,344 | A | 9/1986 | O'Connor | 273/283 |
| 4,784,394 | A | 11/1988 | Sumin | 273/251 |
| 4,809,987 | A | 3/1989 | Dvorak et al. | 273/254 |
| 4,948,144 | A | 8/1990 | Armstrong | 273/249 |
| 5,018,743 | A * | 5/1991 | Maier | A63F 3/00097 273/242 |
| 5,108,111 | A | 4/1992 | Bilodeau | 273/249 |
| 5,460,381 | A | 10/1995 | Smith et al. | 273/238 |
| 5,478,086 | A | 12/1995 | Aylett | 273/243 |
| 5,529,308 | A | 6/1996 | Masakayan | 273/243 |
| 5,607,159 | A | 3/1997 | Bryson | 273/243 |
| 5,722,834 | A | 3/1998 | Rivera et al. | 434/128 |
| 5,876,034 | A | 3/1999 | Stafford | 273/244 |
| 6,050,567 | A | 4/2000 | Zucco | 273/246 |
| 6,257,576 | B1 | 7/2001 | Pontacoloni | 273/244 |
| 6,267,375 | B1 | 7/2001 | Bernstein et al. | 273/242 |
| 6,361,048 | B1 | 3/2002 | Lynn | 273/280 |
| 6,394,454 | B1 | 5/2002 | Etherington, Jr. et al. | 273/243 |
| 6,488,283 | B1 | 12/2002 | Grundy | 273/253 |
| 6,786,486 | B1 | 9/2004 | Otremba | 273/282.1 |
| 6,871,853 | B2 | 3/2005 | Bedford | 273/243 |
| 7,219,894 | B2 | 5/2007 | Stewart et al. | 273/236 |
| 7,467,795 | B2 | 12/2008 | Middleton, Jr. | 273/239 |
| 7,658,385 | B2 | 2/2010 | Drouhard | 273/249 |
| 7,665,734 | B2 | 2/2010 | Williams | 273/251 |
| 7,806,406 | B1 | 10/2010 | Simikic | 273/243 |
| 8,172,230 | B2 | 5/2012 | Killgo et al. | 273/248 |
| 8,808,003 | B2 | 8/2014 | Northcutt | 434/129 |
| 9,095,768 | B1 | 8/2015 | Bohadi | 273/259 |
| 9,468,839 | B1 | 10/2016 | Bryan | 273/242 |
| 2002/0089121 | A1* | 7/2002 | Bjornson | A63F 3/00097 273/284 |
| 2005/0161880 | A1 | 7/2005 | Vance | 273/244 |
| 2006/0012121 | A1 | 1/2006 | Vance | 273/242 |
| 2008/0042351 | A1 | 2/2008 | Brockman | 273/244 |
| 2009/0220925 | A1 | 9/2009 | Reihana | 434/128 |
| 2010/0140868 | A1 | 6/2010 | Gutierrez Moyano et al. | 273/259 |
| 2011/0101610 | A1 | 5/2011 | Mayalidag | 273/254 |
| 2012/0200036 | A1 | 8/2012 | Klopfenstein | 273/239 |
| 2016/0059113 | A1 | 3/2016 | Caldwell et al. | |

* cited by examiner

SQUIRREL GATHERING NUTS GAME APPARATUS AND METHOD

CROSS-REFERENCE TO RELATED APPLICATIONS

This application claims priority to and is a continuation-in-part of U.S. patent application Ser. No. 15/806,628, filed on Nov. 8, 2017 entitled SQUIRREL GATHERING NUTS GAME APPARATUS AND METHOD which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in board games. More particularly, the invention relates to improvements particularly suited for a multi board combinable game with unique play elements. In particular, the present invention relates specifically to a squirrel gathering nuts game including a tree board including a starting position, movement markers, a card access position, nut positions, multiple nut values, launch positions, launch directions, and landing positions along with dice, squirrel position markers, and nut position markers.

2. Description of the Known Art

As will be appreciated by those skilled in the art, board games are known in various forms. Patents disclosing information relevant to board games include: U.S. Pat. No. 4,948,144, issued to Armstrong on Aug. 14, 1990 entitled Game playing apparatus; U.S. Pat. No. 4,016,939, issued to Thron on Apr. 12, 1977 entitled Board game apparatus; U.S. Pat. No. 8,808,003, issued to Northcutt on Aug. 19, 2014 entitled Lunch box board game; and U.S. Pat. No. 7,665,734, issued to Williams on Feb. 23, 2010 entitled Game and the method of playing the game. Each of these patents is hereby expressly incorporated by reference in their entirety.

From these prior references it may be seen that these prior art patents are very limited in their teaching and utilization, and an improved board game kit is needed to overcome these inventions.

SUMMARY OF THE INVENTION

The present invention is directed to an improved board game kit using a game board with a tree and limbs. In accordance with one exemplary embodiment of the present invention, a squirrel gathering nuts game kit is provided using a game box with a first tree board defining a main trunk and limbs. Squirrel markers are moved up the main trunk and around the limbs to collects nuts of various values. The squirrel markers can jump to adjacent limbs, the ground, and to additional boards representing additional trees that are placed next to the side or top of the starting game board. Roll dice are used to set move values for each players turn, and move and/or point cards are provided. Jump direction arrows are positioned adjacent to the ground and cross board jump positions to guide the players. Objects of the game include entertainment and education regarding the life of a squirrel and their movements in collecting food represented as tree nuts. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
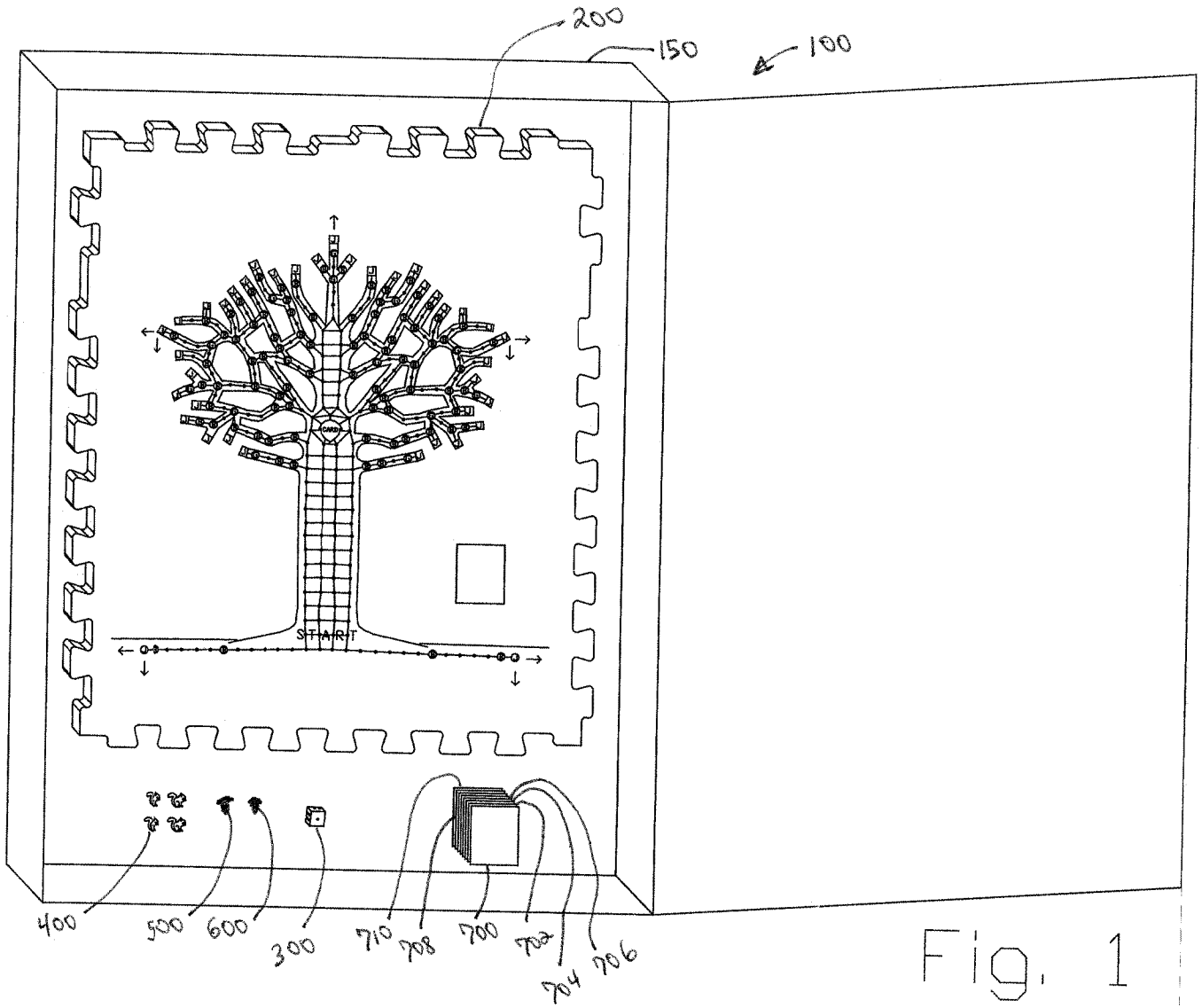
FIG. 1 is a schematic view of a squirrel gathering nuts game kit.
Figure 2:
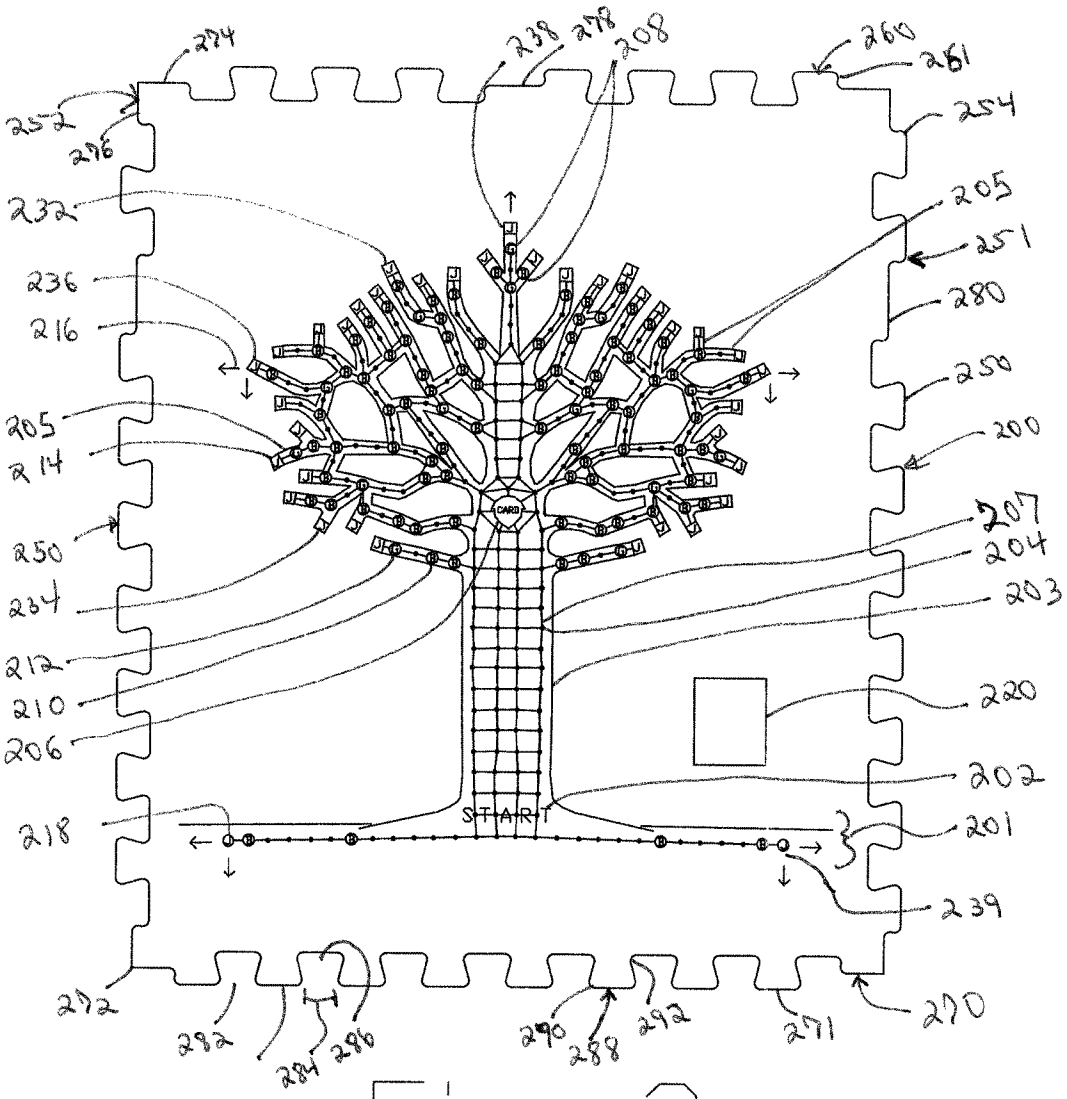
FIG. 2 is a schematic view of the tree board.

As shown in FIGS. 1 through 14 of the drawings, one exemplary embodiment of the present invention is generally shown as a squirrel gathering nuts game kit 100. The squirrel gathering nuts game kit 100 includes a game box 150 for housing a tree board 200, a six sided die 300, four squirrel position markers 400, low value acorn nut markers 500, high value acorn nut markers 600, and game cards 700.

The tree board 200 includes a ground position 201, a main trunk 203, and limbs 205, as well as a card storage position 220. The tree board has left and right board sides 250, a board top 260, and a board bottom 270. The board sides 250 are made with a rotation blocking side pattern 251 using a left orientation control side 252 and a right orientation control side 254. The left orientation control side 252 and right orientation control side 254 mate into each other when the boars are properly aligned and do not mate when the boards are rotated. Similarly, the board top 260 is made with a half rotation top control pattern 261 that is mirrored on the vertical centerline and vertically flipped so that two board tops will mate when the board is rotated top to top. Similarly, the board bottom 270 uses a half rotation bottom control pattern 271 so that two board bottoms will mate when the board is rotated bottom to bottom. Note however that the half rotation top control pattern 261 does not mate with the half rotation bottom control pattern 271 such that a top to bottom orientation is prohibited. Each pattern uses a unique combination of a square corner 272 with a top corner shoulder 274 and bottom side corner shoulder 276, the top uses a centered mid shoulder 278 while the sides use an offset mid extension shoulder 280. The left and right board sides 250, board top 260, and board bottom 270 all use rounded corner recessed fantail apertures 282 with an exterior aperture neck 284 and interior aperture bowl 286 that are sized to mate with a corresponding rounded corner extending fantail pin 288 with exterior pin head 290 and interior pin neck 292.

The ground position 201, a main trunk 203, and limbs 205 include movement markers 204, connecting lines 207, and nut positions 208. The main trunk 203 includes both a starting position 202 and a card access position 206. The nut positions 208 can be either a low value nut position 210 or a high value nut position 212. Each limb 205 ends with a jump position 214 and jump direction arrows 216 provide on board guidance for particular jump positions 214. The jump position 214 can either be an adjacent jump position 232, an adjacent or ground jump position 234, a side board jump position 236, a top board jump position 238 or a bottom board jump position 239. The ground position 201 also includes landing positions 218.

The die 300 is a six sided die with each side having a unique number from one to six.

The squirrel position marker 400 is a squirrel shaped figurine sized to fit on a single movement marker on the game board.

The low value acorn nut marker 500 is a small brown acorn shaped figurine sized to fit on a single low value nut position 210 on the game board.

The high value acorn nut marker 600 is a small gold acorn shaped figurine sized to fit on a single high value nut position 212 on the game board.

The game cards 700 are laminated cards sized to fit in a stack on the card position 220. Game cards include a move up the tree cards 702, move down the tree cards 704, move any direction cards 706, move to start cards 708, and point cards 710.

In the preferred embodiment, the move up the tree cards 702 include cards with instructions to "move toward the top eight moves", "move toward the top ten moves", and "move toward the top twelve moves." The move any direction cards 706 includes instructions to "move any direction 8 moves", "move any direction 10 moves", and "move any direction 12 moves." The move down the tree card 704 includes instructions to "go straight down the trunk 6 moves." The move to start cards 708 includes instructions to "go to the bottom of the trunk to the start position." The point cards 710. Include instructions to "keep this card, worth 5 points", "keep this card, worth 10 points," and "keep this card, worth 15 points."

Game Instructions

The game kit 100 is intended for players ages five years old and up. Up to four players can play per board 200. Each low value acorn nut marker 500 is made as a small brown acorn and is worth one point. Each high value acorn nut marker 600 is made as a large gold acorn and is worth ten points. To play the game quicker, players can use only the high value acorn nut marker 600 made as large gold acorns. Jump positions 214 are indicated by a J on the board 200.

The player places the markers 500, 600 provided as acorns on the tree locations 208. Thus, a low value marker 500 as a brown acorn goes at each circle B, and a high value marker 600 as a gold acorn goes at each circle G.

The players will each choose a unique color squirrel position marker 400 and place it on the START position 202.

To determine who goes first, the players all takes turns and roll the six-sided die 300 to compare the number on top of the die 300, a number between 1 and 6. The person with the lowest number goes first, and the others go in ascending order. If there is a tie, the tied people roll the die 300 again to see who will go before the other and the person with the lowest number again going first.

Each player in turn will roll the die 300 to determine how many moves they make of the squirrel position marker 400 by the number on top of the dice when rolled. The player can move the squirrel position marker 400 from one movement markers 204 along any of the connecting lines 207 dot to any adjacent movement marker 204 in any direction as long as the two movement markers 204 are joined by a connecting line 205. The player can move the squirrel position marker 400 both forward (counts as one move) and backward (counts as one move) during a turn. Thus, a player can move the squirrel position marker 400 both forward and backward to be back on the same movement marker 204 or cross oven the same movement marker 204 where the squirrel position marker 400 started. A player cannot move the squirrel position marker 400 to a location occupied by another squirrel position marker 400 except for the mystery card access location 206. A player cannot jump another squirrel position marker 400 to get past it.

While moving the squirrel position marker 400 the number of moves indicated by the die 300 roll, a player may collect any acorn nut markers 500, 600 located on the spot where the squirrel position marker 400 is moved both during and at the end of the turn. Thus, multiple acorn nut markers 500, 600 may be collected on any turn.

Players cannot move the squirrel position marker 400 from limb 500 to limb 500 except where the limbs 500 intersect as indicated by the connecting lines 207.

When at the end of a limb 500 on a jump position 214, shown as a green jump point in the preferred embodiment, then a player can jump the squirrel position marker 400 to varying points depending on the type of jump position 214. The simplest type of jump position 214 is the adjacent jump position 232 that allows jumping to any proximate jump position 214. Next is the ground jump position 234 that allows jumping to both the landing position 218 and any proximate jump position 214. Next is the side board jump position 236 that allows jumping in multiple board play to another board 200 placed alongside the board 200 that the player is playing on as well as to both the landing position 218 and any proximate jump position 214. Finally, there is the top board jump position 238 that allows jumping in multiple board play to another board 200 placed at the top of the board 200 that the player is playing on as well as to any proximate jump position 214. Thus one can see that starting from the top of the tree 200, the tree's top most limb has a top board jump position 238, then the upper branches only have adjacent jump positions 232 until one reaches the side board jump position 236, with all of the bottom branches having ground jump positions 234.

When a player moves the squirrel position marker 400 onto the large acorn mystery card access position 206, the player pulls the top mystery card 700 from the card storage position 220 and follows the instructions on the card 700.

When play is finished, all of the pieces 200, 300, 400, 500, 600, 700 are returned to the game box 150.

Multiple Board Play

Figure 3:
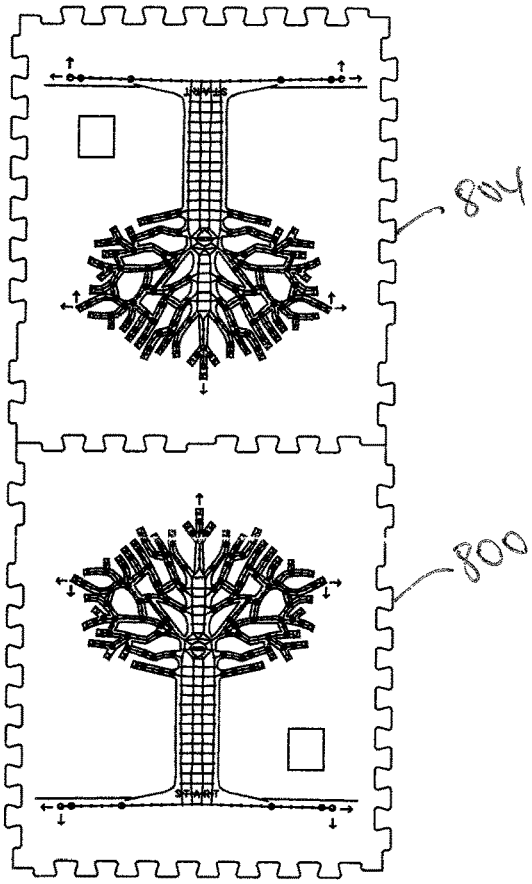
FIG. 3 is a schematic view of two tree boards in a top to top relationship.
Figure 4:
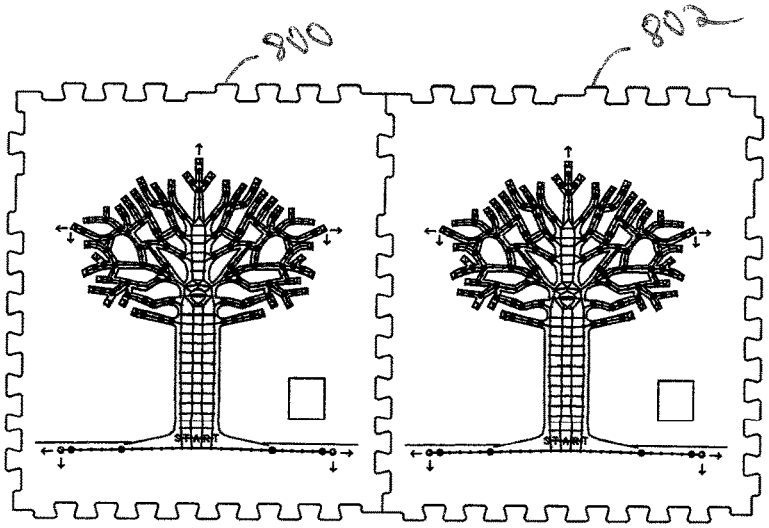
FIG. 4 is a schematic view of two tree boards in a side by side relationship.
Figure 5:
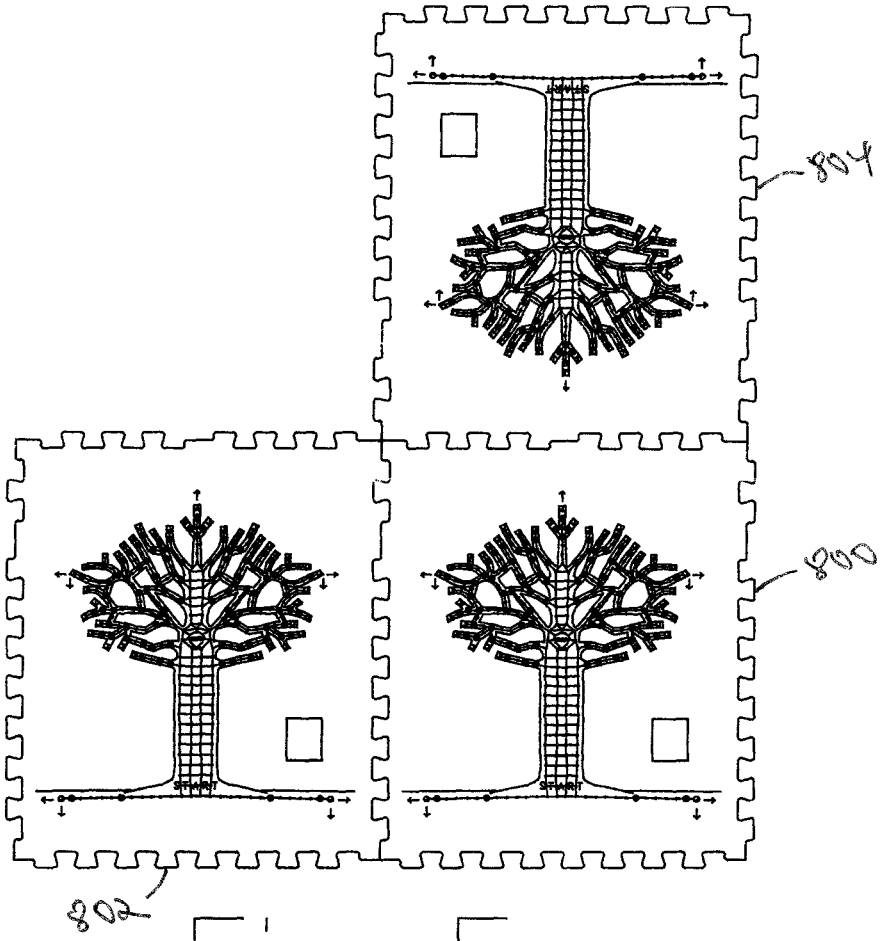
FIG. 5 is a schematic view of three tree boards using both a side by side and top to top relationship.
Figure 6:
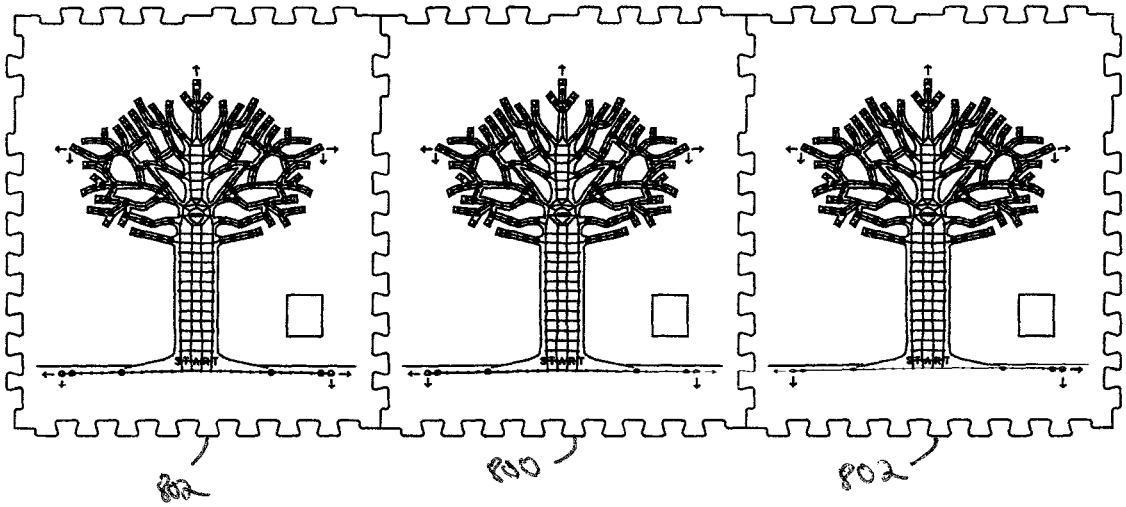
FIG. 6 is a schematic view of three tree boards using multiple side by side relationships.
Figure 7:
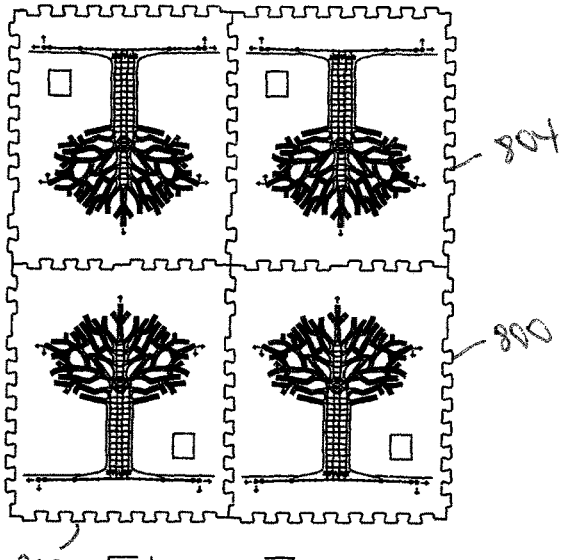
FIG. 7 is a schematic view of four tree boards using two a side by side and two top to top relationships.
Figure 8:
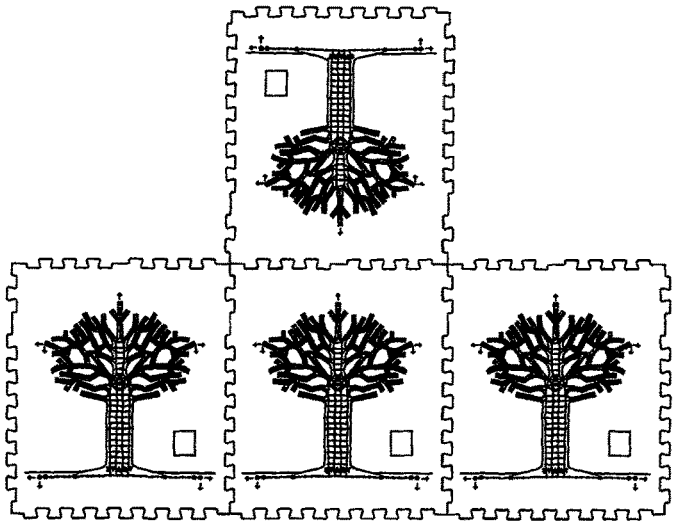
FIG. 8 is a schematic view of four tree boards using two a side by side and one top to top relationships.
Figure 9:
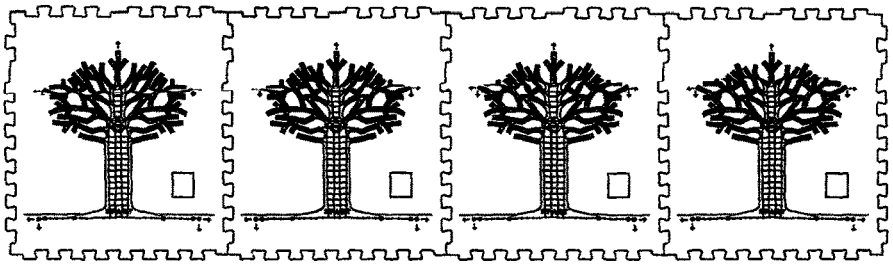
FIG. 9 is a schematic view of four tree boards using three side by side relationships.
Figure 10:
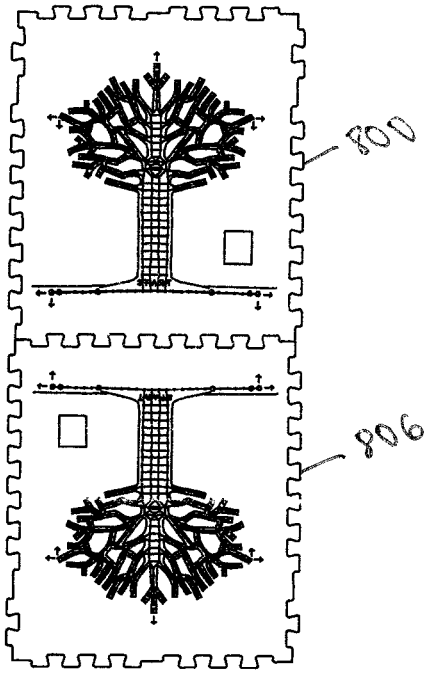
FIG. 10 is a schematic view of two tree boards in a bottom to bottom relationship.
Figure 11:
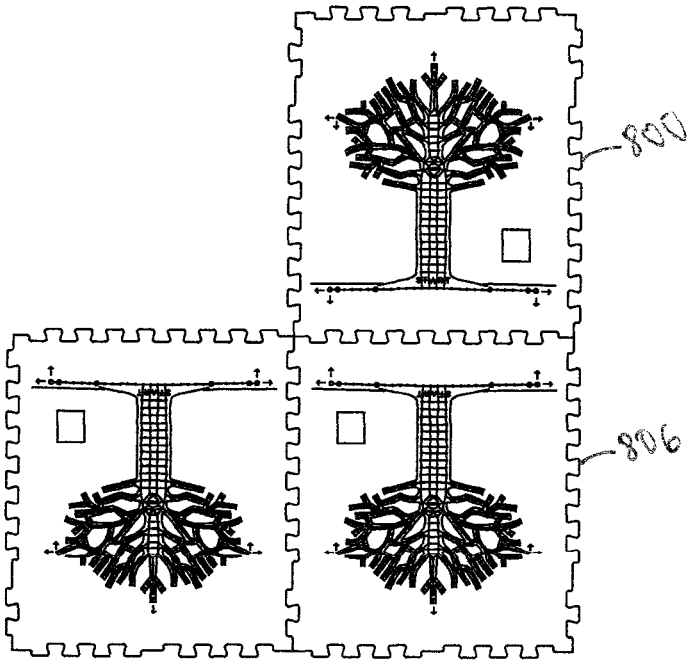
FIG. 11 is a schematic view of three tree boards using both a side by side and bottom to bottom relationship.
Figure 12:
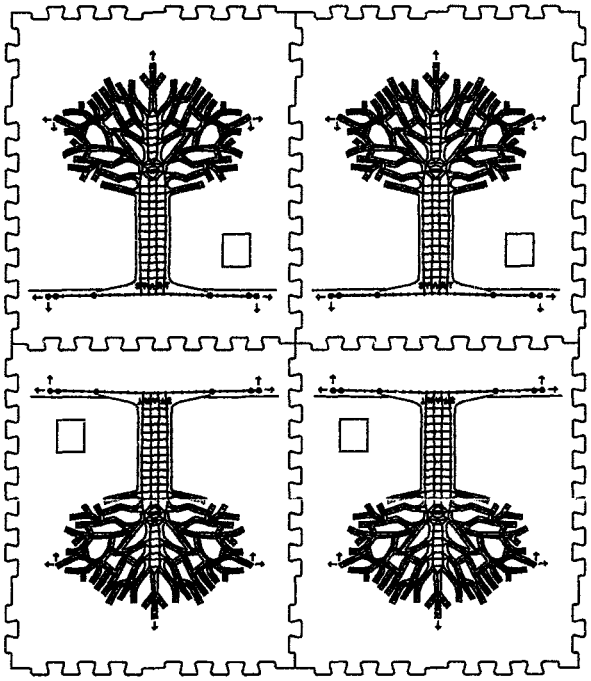
FIG. 12 is a schematic view of four tree boards using both a side by side and bottom to bottom relationship.
Figure 13:
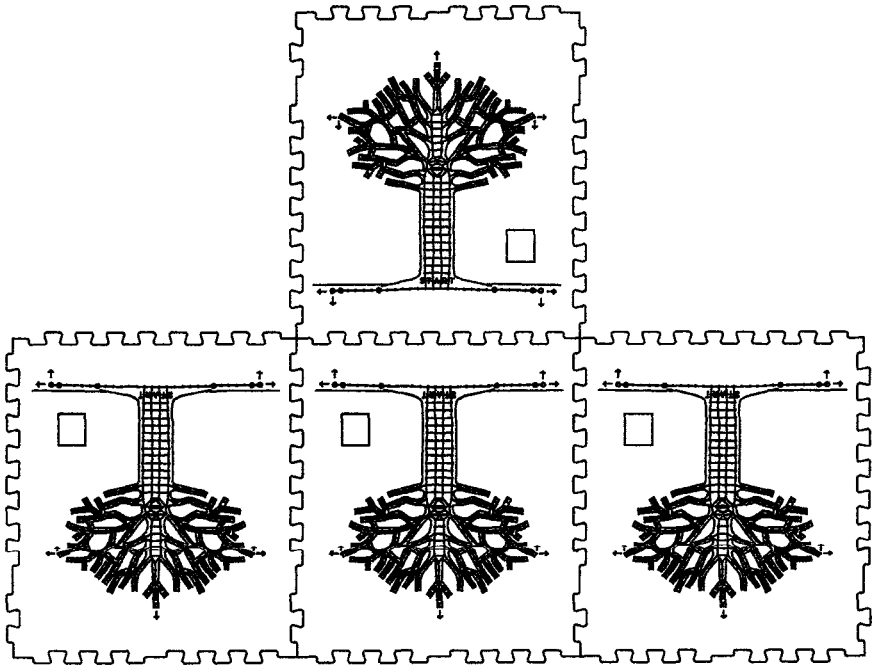
FIG. 13 is a schematic view of four tree boards using both a side by side and bottom to bottom relationship.
Figure 14:
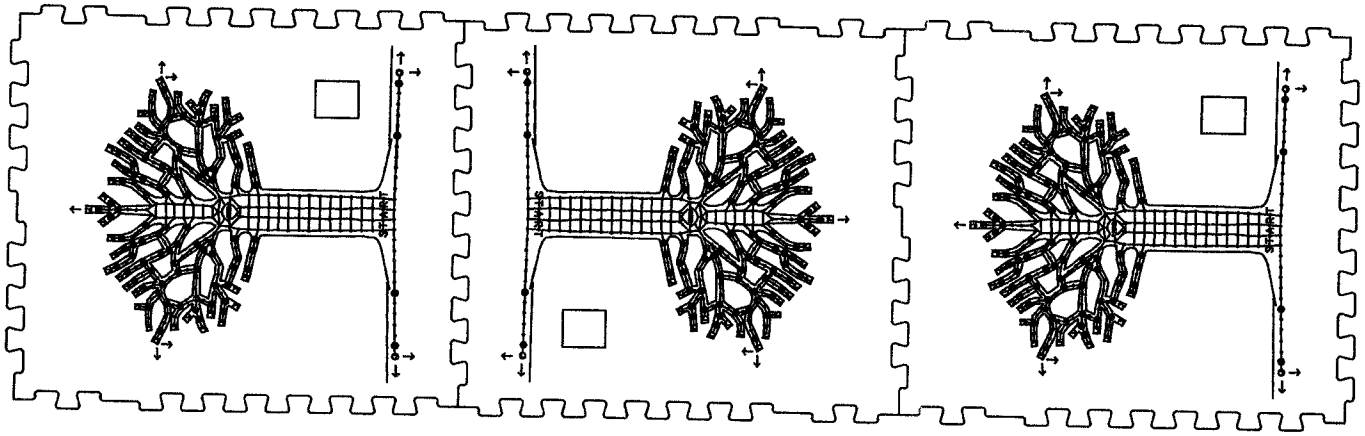
FIG. 14 is a schematic view of three tree boards using both a top to top and bottom to bottom relationship.

As shown in FIGS. 3 through 9, starting with a game board 200 that we will label as a first game board 800 for this discussion, additional game boards 200 can be placed on each side to make both left and right versions of a side game board 802 and/or on top of any board to make a top game board 804 or on the bottom for a bottom game board 806 such that any number of boards 200 can be used. For each additional board 200, four additional squirrel position markers 400 and one additional dice 300 may be used. Each player can choose between the various start positions 202 on the multiple boards 200. Thus, as shown in FIGS. 3 and 4, for a two board 200 game, the player can choose between the START position 202 on the two different boards 200, and can roll the two dice and add together the numbers on top of the dice 300 when rolled to determine the number of moves of the squirrel position marker 400, a number between 2 and 12. As shown in FIGS. 5 and 6, for a three board 200 game, the player can choose between the START position 202 on the three different boards 200, and can roll the three dice 300 and add together the numbers on top of the dice 300 when rolled to determine the number of moves of the squirrel position marker 400, a number between 3 and 18. As shown in FIGS. 7, 8, and 9, for a four board 200 game, the player can choose between the START position 202 on the four different boards 200, and can roll the four dice 300 and add together the numbers on top of the dice 300 when rolled to determine the number of moves of the squirrel position marker 400, a number between 4 and 24.

When on a landing position 218, the player can move the squirrel position marker 400 to the proximate landing position 218 on any side game board 802.

When on the furthermost side limb 500 at the side jump position 236 a player can jump the squirrel position marker 400 to the proximate jump position 238 on the adjoining side game board 802.

When on the furthermost top limb 500 at the top jump position 238 a player can jump the squirrel position marker 400 to the proximate top jump position 238 on the adjoining top game board 804. Similarly, when on the furthermost bottom board jump position 239 a player can jump the squirrel position marker 400 to the to the proximate bottom board jump position 239 on the adjoining bottom game board 806.

Reference numerals used throughout the detailed description and the drawings correspond to the following elements:

- a squirrel gathering nuts game kit 100
- game box 150
- tree board 200
  - ground position 201
  - starting position 202
  - main trunk 203
  - movement markers 204
  - limbs 205
  - card access position 206
  - connecting lines 207
  - nut positions 208
  - low value nut position 210
  - high value nut position 212
  - jump position 214
  - jump direction 216
  - landing position 218
  - card storage position 220
  - adjacent jump position 232
  - ground jump position 234
  - side board jump position 236
  - top board jump position 238
  - bottom board jump position 239
  - board side 250
    - rotation blocking side pattern 251
    - left orientation control side 252
    - right orientation control side 254
  - board top 260
    - half rotation top control pattern 261
  - board bottom 270
    - half rotation bottom control pattern 271
  - square corner 272
  - top corner shoulder 274
  - side corner shoulder 276
  - mid shoulder 278
    - mid extension shoulder 280
    - rounded corner recessed fantail aperture 282
      - exterior aperture neck 284
      - interior aperture bowl 286
    - rounded corner extending fantail pin 288
      - exterior pin head 290
      - interior pin neck 292
- dice 300
- squirrel position marker 400
- low value acorn nut marker 500
- high value acorn nut marker 600
- game card 700
  - move up the tree card 702
  - move down the tree card 704
  - move any direction card 706
  - move to start card 708
  - point card 710
- first game board 800
- side game boards 802
- top game board 804
- bottom game board 806

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A squirrel gathering nuts game kit, comprising:

a game box;

a first tree board having a right side with a rotation blocking side pattern;

a left side with a rotation blocking side pattern, wherein the left side and right side rotation blocking side patterns will mate with each other only in a single orientation;

a vertical center line;

a top with a half rotation top control pattern having a first segment on a first side of the vertical center line and a second segment on a second side of the vertical center line, the second segment being identical to the first segment mirrored across the vertical center line and vertically flipped from the first segment;

a bottom with a half rotation bottom control pattern, wherein the half rotation top control pattern does not mate with the half rotation bottom control pattern, wherein the half rotation top control pattern will mate with another half rotation top control pattern and wherein the half rotation bottom control pattern will mate with another half rotation bottom control pattern;

a first ground position, a first main trunk, at least one first limb with a first end, a first starting position located on the first main trunk, first movement markers joined by first connecting lines dispersed along the first main trunk and the at least one first limb, a first nut position located on the at least one first limb, and the first movement markers including a first jump position on the first end of the at least one first limb;

the first movement markers including a first landing position for the first jump position positioned on the first tree board below the first jump position;

a first die with numbers;

a first squirrel position marker sized to fit on the first movement markers; and a first nut marker sized to fit on the first nut position markers.

2. The kit of claim 1, the first nut position comprising:

a first value first nut position and a second value first nut position.

3. The kit of claim 1, the first board further comprising:

a first jump direction arrow positioned adjacent to the first jump position.

4. The kit of claim 1, further comprising:

a second tree board mating with the first tree board, the second tree board including at least one second limb with a second end and a second jump position on the second end of the at least one second limb;

a first jump direction arrow positioned adjacent to the first jump position, the first jump direction arrow directing to the second jump position.

5. The kit of claim 4, the second game board comprising:

a side game board mated with the first game board.

6. The kit of claim 4, the second game board comprising:

a top game board mated with the first game board.

7. The kit of claim 1, the first ground position further comprising:

a first jump direction arrow positioned adjacent to the first jump position, the first jump direction arrow directing to the first landing position.

8. The kit of claim 1, the board further comprising:

a card storage position.

9. The kit of claim 1, the first jump position further comprising:

a ground jump position.

10. The kit of claim 1, the first jump position further comprising:

a side board jump position.

11. The kit of claim 1, the first jump position further comprising:

a top board jump position.

12. The kit of claim 1, further comprising:

a first card access position on the first main trunk; and a game card.

13. The kit of claim 12, the game card further comprising:

a move up the tree card.

14. The kit of claim 12, the game card further comprising:

a move down the tree card.

15. The kit of claim 12, the game card further comprising:

a move any direction card.

16. The kit of claim 12, the game card further comprising:

a move to start card.

17. The kit of claim 12, the game card further comprising:

a point card.

18. The kit of claim 1, further comprising:

a second game board mated with the first game board; and a third game board mated with the first game board.

* * * * *